US006155222A

United States Patent [19]

Isoshima et al.

[11] Patent Number: 6,155,222

[45] Date of Patent: Dec. 5, 2000

[54] OVERHEAD VALVE ENGINE

[75] Inventors: Hiroaki Isoshima; Shin Isomura, both of Sakai, Japan

[73] Assignee: Kubota Corporation, Japan

[21] Appl. No.: 09/250,264

[22] Filed: Feb. 16, 1999

[51] Int. Cl.[7] ..... F01L 1/00; F01L 1/18

[52] U.S. Cl. ..... 123/90.41; 123/90.36

[58] Field of Search ..... 123/90.27, 90.39, 123/90.41, 90.61, 90.33, 90.36

[56] References Cited

U.S. PATENT DOCUMENTS 2,401,480 6/1946 Halliday ..... 123/90.39

5,970,932 10/1999 Richardson et al. ..... 123/90.36

*Primary Examiner*—Weilun Lo

*Attorney, Agent, or Firm*—Bacon & Thomas PLLC

[57] ABSTRACT

An overhead valve engine has rocker arm pivoted portions (13),(13) oriented substantially in a right and left direction and arranged side by side in a front and rear direction. Each of rocker arm output portions (15),(15) projects from one end portion of each of the rocker arm pivoted portions (13),(13) in a direction opposite to a space between the pivoted portions (13),(13). Each of rocker arm input portions (16),(16) projects from the other end portion of each of the pivoted portions (13),(13) toward the space between the pivoted portions (13),(13). The respective rocker arm input portions (16),(16) are arranged side by side between the rocker arm pivoted portions (13),(13) in the right and left direction.

9 Claims, 6 Drawing Sheets

FEG. 1(A)
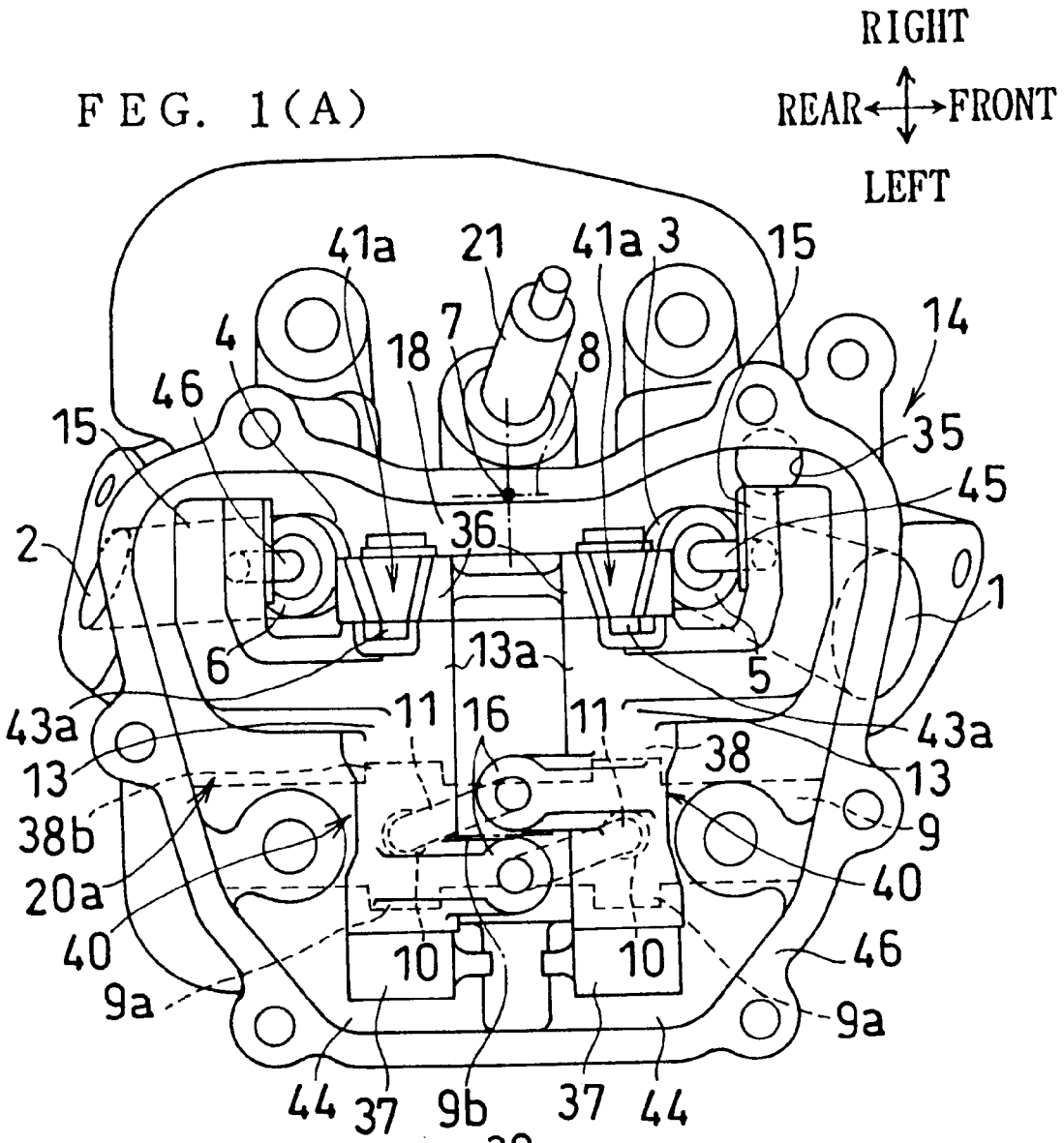
FEG. 1(B)
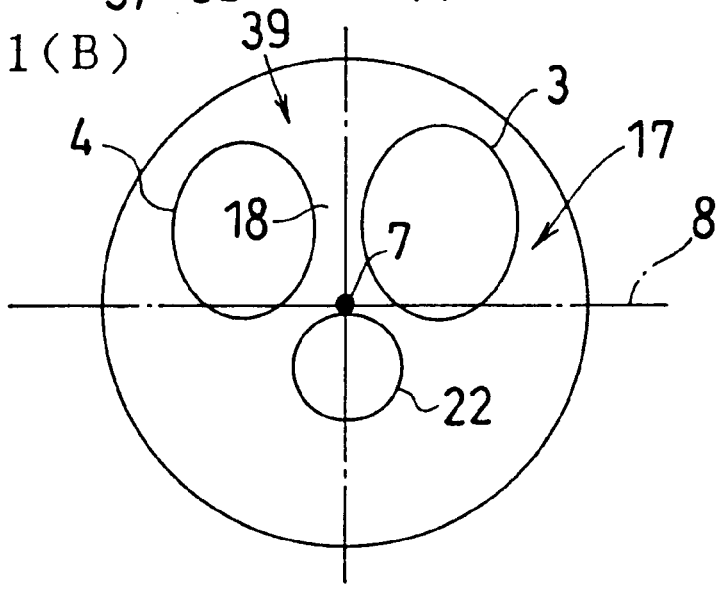

FEG. 2
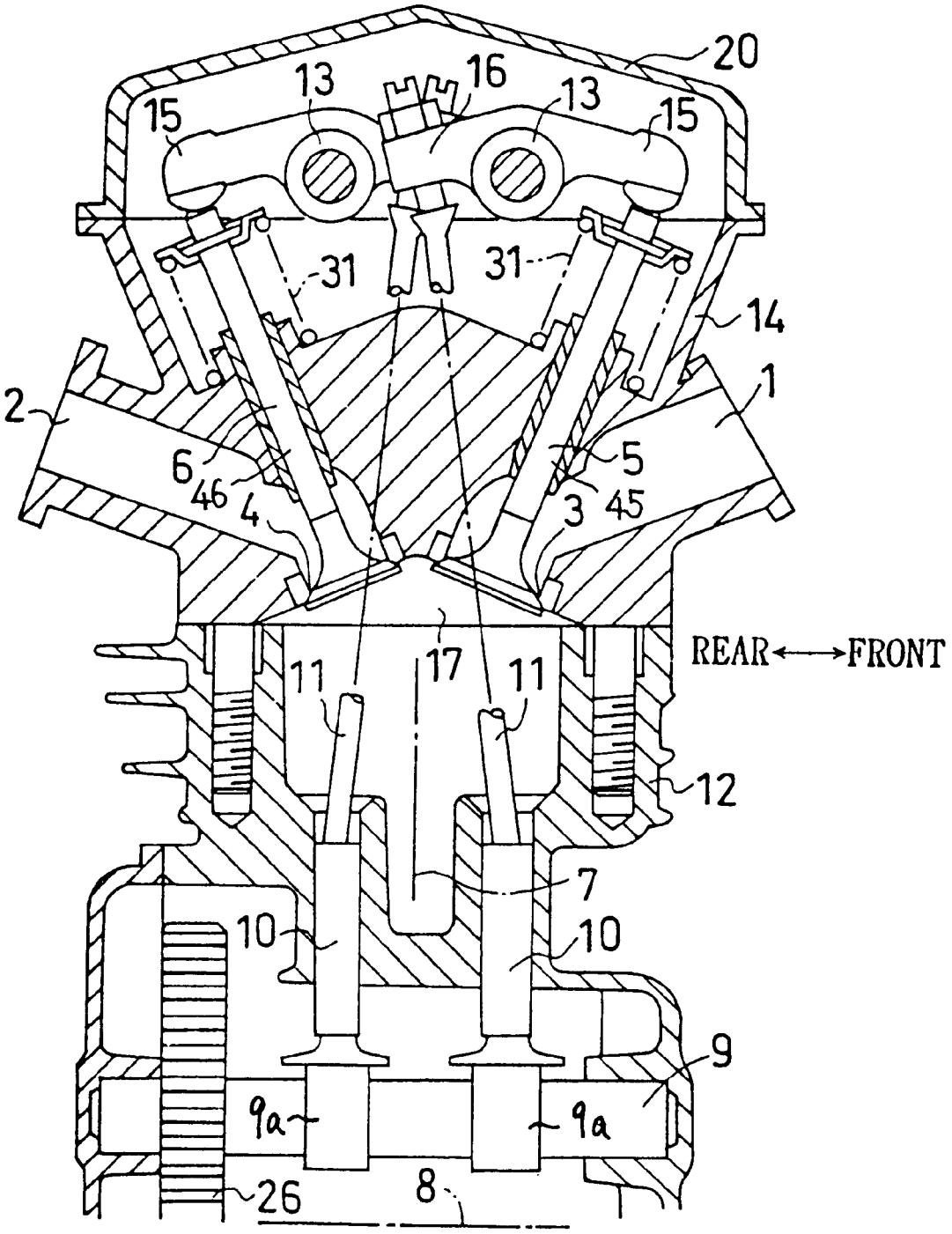

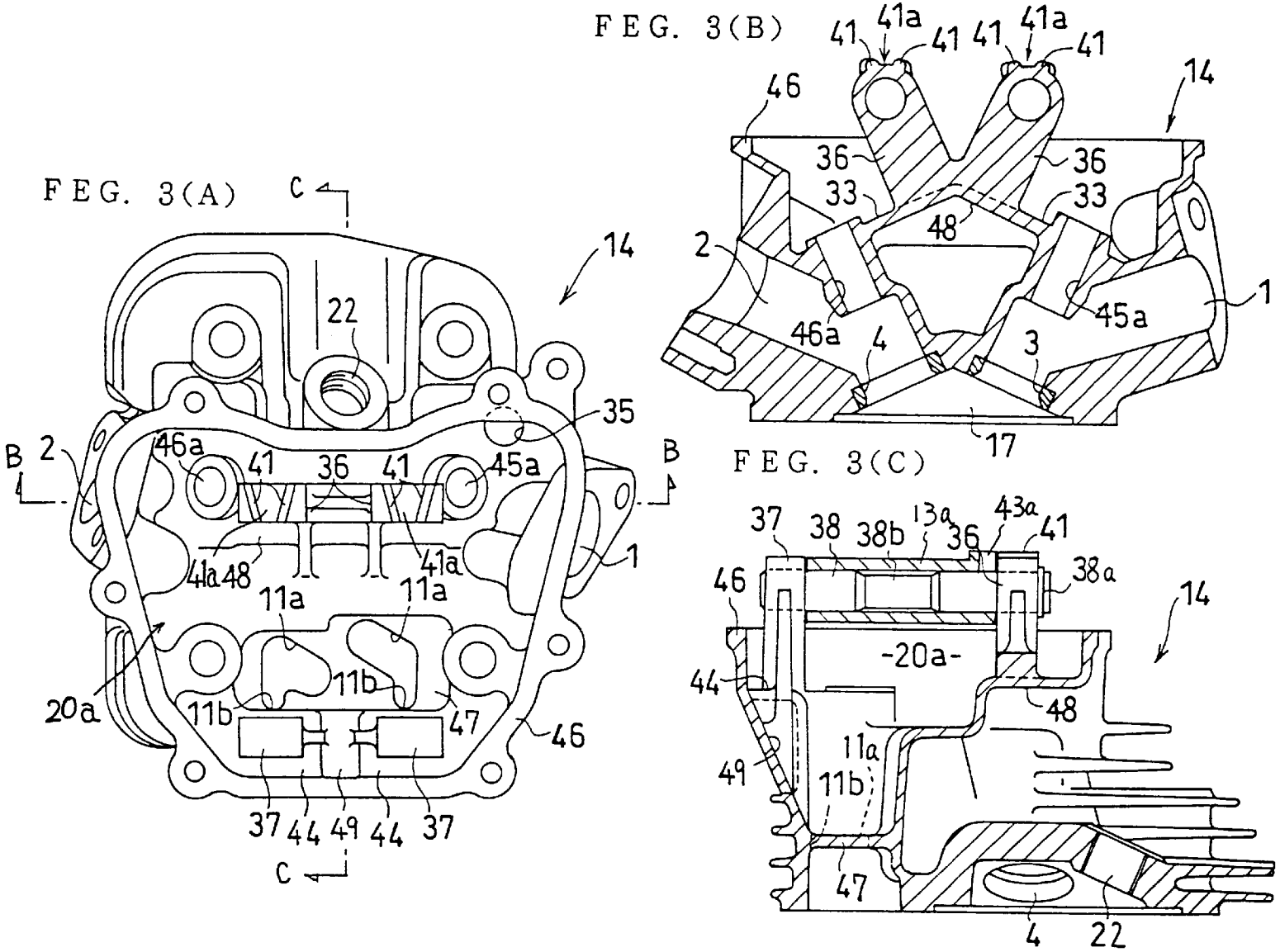
FEG. 3(B)
FEG. 3(C)
FEG. 3(A)
14
1
2
3
4
17
22
33
35
36
37
38
38a
38b
41
41a
43a
44
45a
46
46a
47
48
49
11a
11b
13a
20a
B
C FEG. 4(B)
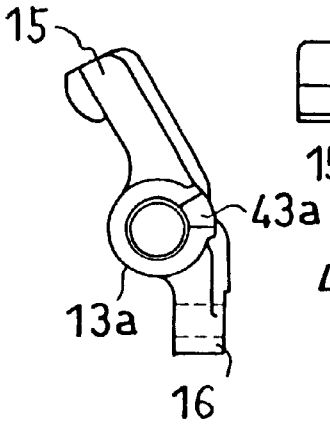
FEG. 4(A)
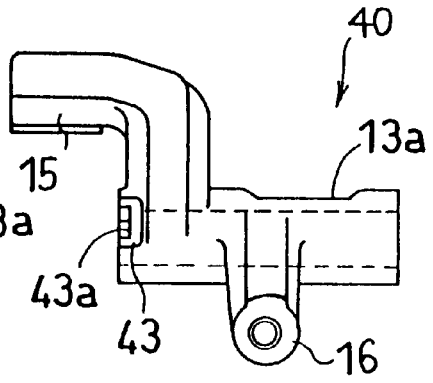
FEG. 4(C)
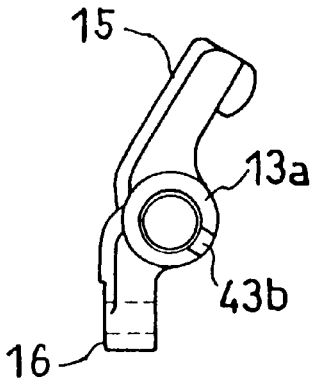

FEG. 6(A)
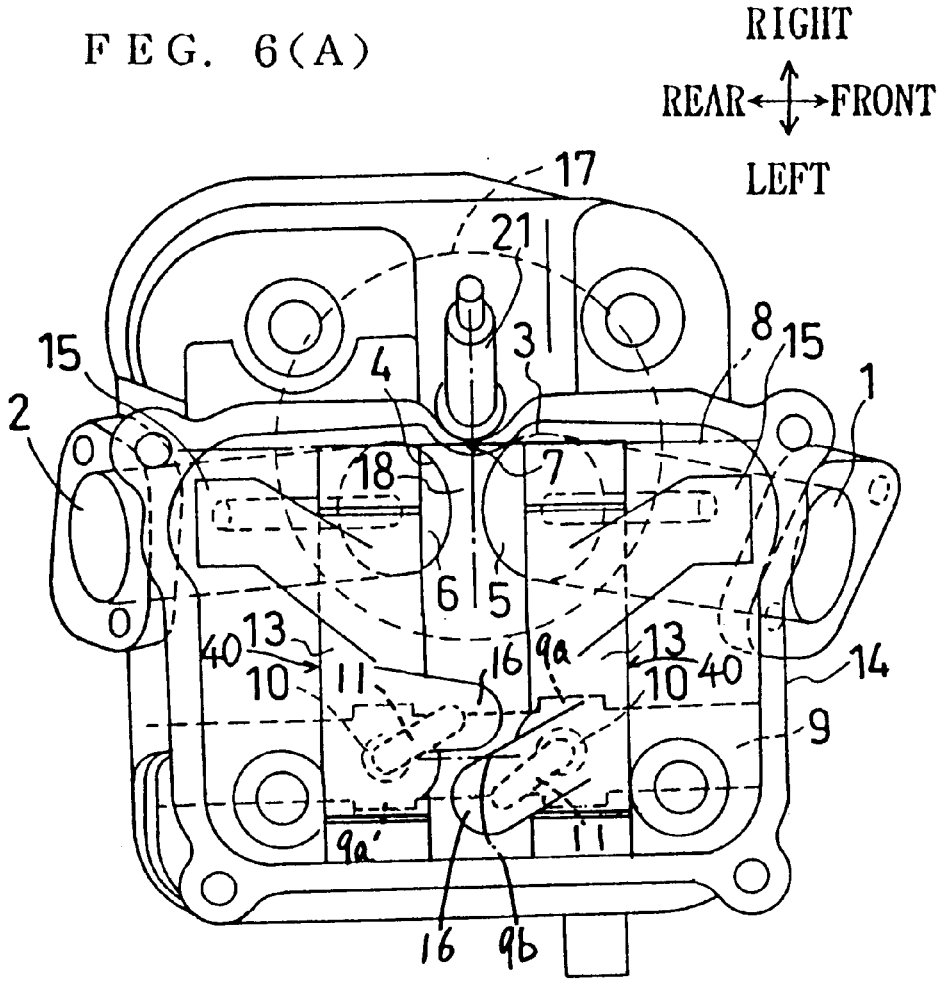
FEG. 6(B)
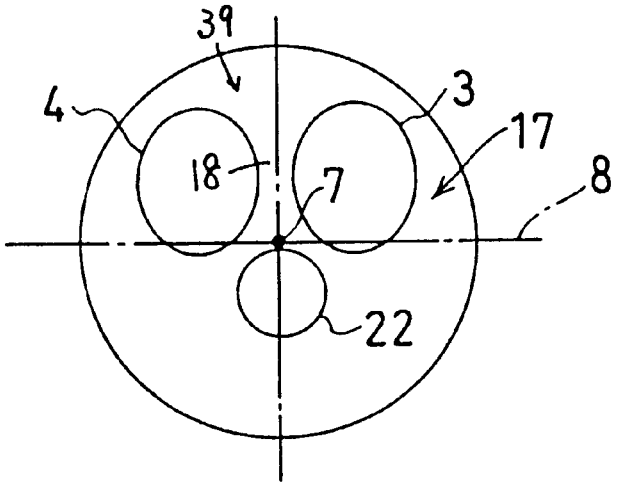

OVERHEAD VALVE ENGINE

DETAILED DESCRIPTION OF THE INVENTION

1. Technical Field of the Present Invention

The present invention relates to an overhead valve engine.

2. Earlier Technology

There exists such a conventional technique of the overhead valve engine as comprising an intake port and an exhaust port, the intake port and the exhaust port projecting from the respective of an intake valve opening and an exhaust valve opening in mutually opposing directions, the intake valve having an axis inclined toward the projecting direction of the intake port, the exhaust valve having an axis inclined toward the projecting direction of the exhaust port. The engine of this type has an advantage of being able to enhance the intake and exhaust efficiency since it can be provided with large intake and exhaust valves and besides decrease a curving degree of each of the intake port and the exhaust port.

The conventional technique adopts a valve operating mechanism of so-called overhead cam type because the axes of the intake valve and the exhaust valve are arranged in a V-shape. This valve operating mechanism comprises a wrapping transmission device arranged in front of a cylinder block when taking an orientation of a crank shaft center axis as a front and rear direction, a cylinder head being provided with a valve operating cam shaft and tappets.

The above-mentioned conventional technique has the following problems.

The wrapping transmission device is arranged in front of the cylinder block. This device is composed of relatively large parts such as a driving wheel, a driven wheel, a wrapping transmission belt and tension, a transmission cover integrally covering them and the like. This construction elongates the engine in the front and rear direction.

Due to the fact that the wrapping transmission device is arranged in front of the cylinder block, in the case of conducting a series of maintenance from the wrapping transmission device to the intake and the exhaust valves, it is necessary to remove both of the transmission cover in front of the cylinder block and a head cover of the cylinder head and effect the maintenance from two ways. Therefore, the maintenance work becomes troublesome. Further, maintenance conditions are so severe that a large restriction is imposed on the type of machines to load the engine.

The cylinder head is provided with the valve operating cam shaft and the tappets. This elongates the engine in a direction of a cylinder center axis.

SUMMARY OF THE INVENTION

The present invention has an object to solve the above problems.

An embodiment of an overhead value engine in accordance with this invention comprises an intake port 1 and an exhaust port 2, the intake port 1 and the exhaust port 2 projecting from the respective of an intake valve opening 3 and an exhaust valve opening 4 in mutually opposing directions, the intake valve 5 having an axis 45 inclined toward the projecting direction of the intake port 1, the exhaust valve 6 having an axis 46 inclined toward the projecting direction of the exhaust port 2, wherein when seen in a direction parallel to a cylinder center axis 7, on the assumption that a crank shaft center axis 8 is oriented in a front and rear direction and that a right and left direction is perpendicular to the crank shaft center axis 8, any one of a valve operating cam shaft 9, the axes 45,46 of the respective valves 5,6, and the respective ports 1,2 being oriented substantially in the front and rear direction, the cam shaft 9, tappets 10,10 and push rods 11,11 being arranged on either of right and left sides of a cylinder block 12, rocker arms 40,40 being provided in a cylinder head 14, rocker arm pivoted portions 13,13 being oriented substantially in the right and left direction and arranged side by side in the front and rear direction, each of rocker arm output portions 15,15 projecting from one end portion of each of the pivoted portions 13,13 in a direction opposite to a space between the pivoted portions 13,13, each of rocker arm input portions 16,16 projecting from the other end portion of each of the pivoted portions 13,13 toward the space between the pivoted portions 13,13, the rocker arm input portions 16,16 being arranged side by side in the right and left direction between the pivoted portions 13,13.

This invention employs a valve operating mechanism wherein the valve operating cam shaft 9, the tappets 10,10, the push rods 11,11 are arranged on either of the right and left sides of the cylinder block 12. Therefore, it can shorten a dimension of the engine in the front and rear direction when compared with the conventional valve operating mechanism of overhead cam type which requires an arrangement of the wrapping transmission device in front of the cylinder block. Further, the present valve operating mechanism can be constructed more compact than the wrapping transmission device and therefore the engine does not have so large a dimension in the right and left direction.

In the case of effecting a series of maintenance from the push rods 11,11 to the respective valves 5,6, it suffices if a head cover 20 is removed from the cylinder head 14 and then the maintenance work is carried out from one way. Accordingly, the maintenance work can be simplified. Besides, maintenance conditions are so moderate that only a small restriction is imposed on the type of machines to load the engine.

Though the cylinder head 14 is provided with the rocker arms 40,40, when compared with the overhead cam type having a cylinder head provided with the valve operating cam shaft and the tappets, the present engine can decrease its dimension in the direction of the cylinder center axis 7.

The respective rocker arm input portions 16,16 are arranged side by side in the right and left direction between the rocker arm pivoted portions 13,13. This arrangement can secure a suitable arm length of each of the rocker arm input portions 16,16 and the rocker arm output portions 15,15 when compared with a case where those input portion 16,16 are arranged in butting relation with each other. Thus it is possible to increase a reliability on the operation of the valve operating device.

When seen in the direction parallel to the cylinder center axis 7, respective cams 9*a*,9*a* of the cam shaft 9 are arranged in the front and rear direction with a mid portion between the rocker arm pivoted portions 13,13 interposed therebetween. The rocker arm input portions 16,16 are disposed in the right and left direction with a center axis 9*b* of the cam shaft 9 interposed therebetween. Thus each of the push rods 11,11 can be inclined with respect to each of the tappets 10,10 at an angle set to be equally small, which results in the possibility of increasing the reliability on the operation of the valve operating device.

One combustion chamber 17 is provided with one intake valve 5 and one exhaust valve 6, respectively. When seen in the direction parallel to the cylinder center axis 7, the respective valves 5,6 have the axes 45,46 arranged at positions deviated toward the push rods 11,11 with reference to the cylinder center axis 7 and brought into butting contact with rocker arm output portions 15,15 at their end portions. Therefore, the rocker arm pivoted portions 13,13 can be shortened to result in twisting only a little. This can enhance an accuracy of the valve operating timing.

The combustion chamber 17 has a pent roof shape. This enlarges a space for arranging the respective valves 5,6, which results in the possibility of arranging them smoothly and also increasing a combustion performance.

Each of the ports 1,2 projects from each of the valve openings 3,4 in a direction opposite to an inter-valve opening portion 18. Accordingly, it is possible to adopt a cross flow system and enhance a scavenging efficiency of the combustion chamber 17.

When seen in the direction parallel to the crank shaft center axis 8, the cylinder 19 is inclined. Further, the valve operating cam shaft 9, the tappets 10,10 and the push rods 11,11 are arranged on a lower one of the right and left sides of the cylinder block 12. This arrangement can decrease a height of the engine.

A rocker arm chamber 20*a* includes bearing boss portions 36,36 at its higher portion, each of which is provided with a downwardly tapering oil guide groove 41*a*. Oil mist is introduced into the rocker arm chamber 20*a* from a crank chamber through a communication passage 35. The thus introduced oil mist pours down on upper faces of the respective bearing boss portions 36,36 at the higher portion as well and then oil is collected by the oil guide grooves 41*a*. The collected oil flows into the respective rocker arm pivoted portions 13,13 by its own weight. Thus it is possible to put this lubricating device into practice by a simpler reconstruction and at a lower cost when compared with a case of supplying lubricant to the valve operating mechanism disposed in the rocker arm chamber through a force feed oil passage. Additionally, even with long rocker arm bosses 13*a*, it is possible to maintain a high lubricating performance.

Each of the rocker arm bosses 13*a*,13*a* has an upper end portion provided with an oil introducing opening 43*a* facing an opening at a lower end of each of the oil guide grooves 41*a*. Accordingly, the oil collected by the oil guide grooves 41*a* is introduced through the oil introducing openings 43*a* facing the lower end openings of the oil guide grooves 41*a* into the rocker arm bosses 13*a*,13*a* to lubricate the rocker arm pivoted portions 13,13. This can present the above function and effect with a higher assuredness.

Each pivot 38 has an axial intermediate portion reduced in diameter to form an oil reservoir 38*b* within each of the rocker arm bosses 13*a*,13*a*. The oil introduced through the oil introducing openings 43*a*,43*a* into the rocker arm bosses 13*a*,13*a* is stored in the oil reservoirs 38*b*,38*b* formed within the bosses 13*a*,13*a* to lubricate the rocker arm pivoted portions 13,13. This can present the above function and effect more reliably.

BRIEF DESCRIPTION OF THE DRAWINGS

FIG. 1 shows an engine according to a first embodiment of the present invention. FIG. 1(A) is a plan view of a cylinder head. FIG. 1(B) is a view of a surface of the cylinder head opposing a piston when seen from the piston side;

FIG. 2 is a vertical sectional side view of the engine's principal parts, which shows the cylinder head shown in FIG. 1 and a cylinder block vertically cut at different positions;

FIG. 3 shows the cylinder head of the engine shown in FIG. 1. FIG. 3(A) is a plan view of the cylinder head. FIG. 3(B) is a sectional view when taken along a line B—B in FIG. 3(A). FIG. 3(C) is a sectional view when taken along a line C—C in FIG. 3(A);

FIG. 4 shows a rocker arm of the engine shown in FIG. 1. FIG. 4(A) is a plan view of the rocker arm.

FIG. 4(B) is a view showing one side of the rocker arm.

FIG. 4(C) is a view showing the other side of the rocker arm;

FIG. 6 shows an engine according to a second embodiment of the present invention. FIG. 6(A) is a plan view of the cylinder head. FIG. 6(B) is a view of a surface of the cylinder head opposing the piston when seen from the piston side.

DESCRIPTION OF THE PREFERRED EMBODIMENTS

Figure 5:
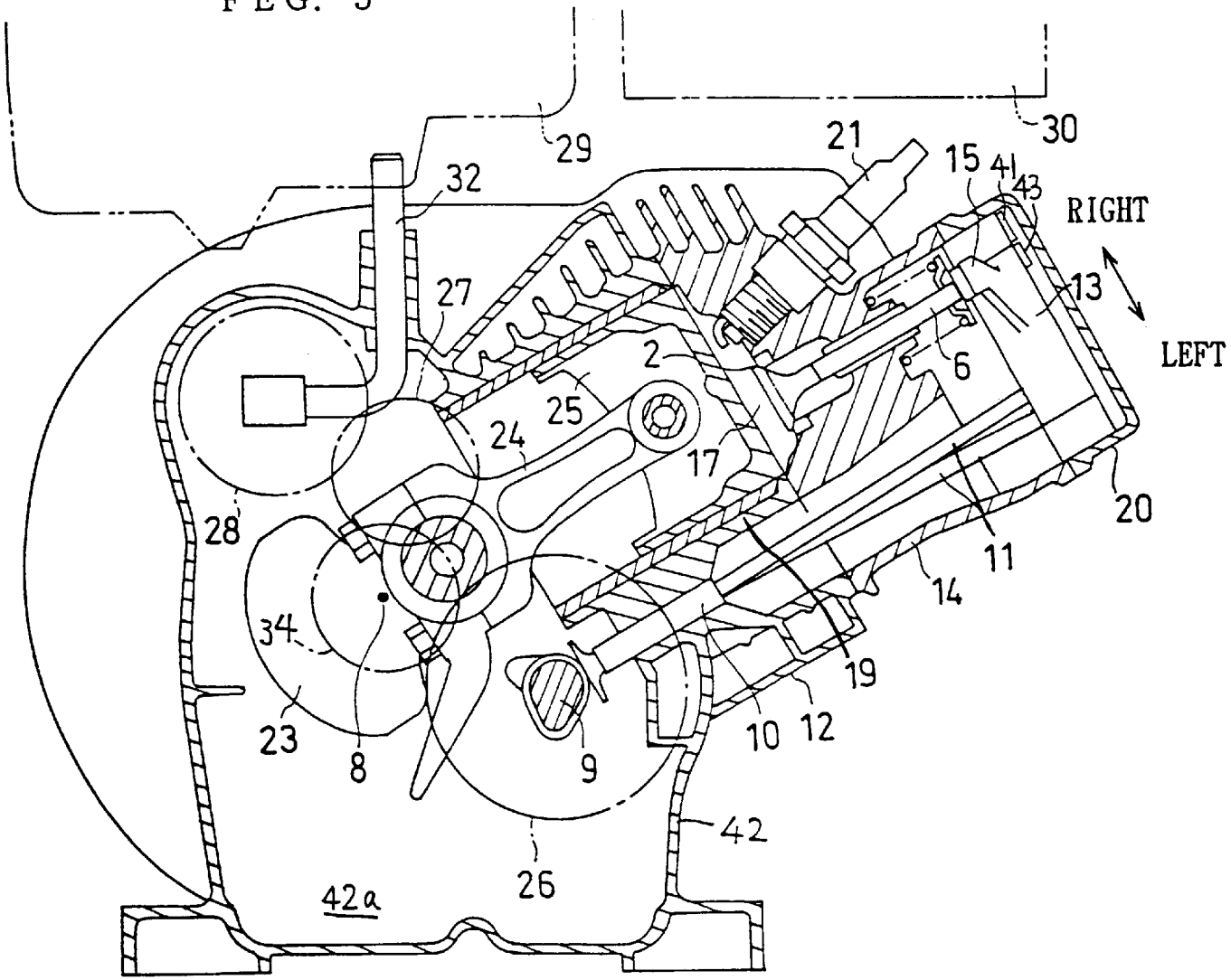
FIG. 5 is a vertical sectional rear view of the engine shown in FIG. 1.

Embodiments of the present invention will be explained with reference to the drawings. FIGS. 1 to 5 explain a first embodiment of the present invention. This first embodiment employs an air-cooled inclined engine of single-cylinder and spark ignition type.

This engine is constructed as follows.

As shown in FIG. 5, a crank case wall 42 and a cylinder 19 form a cylinder block 12. A cylinder head 14 is assembled to the cylinder 19 on a side of the latter's top dead center. A head cover 20 is assembled to the cylinder head 14.

A crank case 42*a* has a crank shaft 23 and a valve operating cam shaft 9 arranged parallel to each other. A piston 25 is integrally fitted into the cylinder 19. The crank shaft 23 is connected to the piston 25 with a con'rod 24. A valve operating cam gear 26 meshes with a crank gear 34, thereby driving the cam shaft 9 through the crank shaft 23. The crank gear 34 also meshes with an idle gear 27, which engages with a governor gear 28 to thereby drive a governor 32 through the crank shaft 23.

The cylinder head 14 and a valve operating mechanism are constructed as follows.

As shown in FIG. 2, an intake port 1 and an exhaust port 2 project from the respective of an intake valve opening 3 and an exhaust valve opening 4 in mutually opposing directions. While an intake valve 5 has an axis 45 inclined toward the projecting direction of the intake port 1, an exhaust valve 6 has an axis 46 inclined toward the projecting direction of the exhaust port 2.

As shown in FIG. 1(A), when seen in a direction parallel to a cylinder center axis 7, on the assumption that a crank shaft center axis 8 is oriented in a front and rear direction and that a right and left direction is perpendicular to the crank shaft center axis 8, any one of the valve operating cam shaft 9, the axes 45,46 of the respective valves 5,6 and the respective ports 1,2 is oriented substantially in the front and rear direction. The valve operating cam shaft 9 is oriented parallel to the crank shaft center axis 8. When seen in the direction parallel to the cylinder center axis 7, the respective valves 5,6 and the respective ports 1,2 are oriented along the crank shaft center axis 8 substantially in the front and rear direction.

The valve operating camshaft 9, tappets 10,10 and push rods 11,11 are arranged on left side of the cylinder block 12. Rocker arms 40,40 are provided in the cylinder head 14. Rocker arm pivoted portions 13,13 are oriented substantially in the right and left direction and arranged side by side in the front and rear direction. Each of rocker arm output portions 15,15 projects from one end portion of each of the pivoted portions 13,13 in a direction opposite to a space between the pivoted portions 13,13. Each of rocker arm input portions 16,16 projects from the other end of each of the pivoted portions 13,13 toward the space between the pivoted portions 13,13. The rocker arm input portions 16,16 are arranged side by side in the right and left direction between the pivoted portions 13,13.

When seen in the direction parallel to the cylinder center axis 7, respective cams 9*a*,9*a* of the valve operating cam shaft 9 are arranged in the front and rear direction with a mid portion between the pivoted portions 13,13 interposed therebetween. The rocker arm input portions 16,16 are arranged in the right and left direction with a center axis 9*b* of the cam shaft 9 interposed therebetween.

Each of the rocker arm pivoted portions 13,13 comprises a rocker arm boss 13*a* externally fitted onto a pivot 38 oriented substantially in the right and left direction. Each of the rocker arm input portions 16,16 is brought into butting contact with an output end portion of each of the push rods 11,11. Each of the rocker arm output portions 15,15 is brought into butting contact with a valve axis end portion of each of the valves 5,6. When seen in the direction parallel to the cylinder center axis 7, the rocker arm pivoted portions 13,13 are oriented substantially in the front and rear direction along a direction perpendicular to the crank shaft center axis 8. Valve springs 31,31 urge the respective valves 5,6 for closing.

As shown in FIG. 2, one intake valve 5 and one exhaust valve 6 are provided for one combustion chamber 17. And as illustrated in FIG. 1(A), when seen in the direction parallel to the cylinder center axis 7, the respective valves 5,6 have their axes 45,46 arranged at positions deviated toward the push rods 11,11 with reference to the crank shaft center axis 8. Each of the valve axis end portions is brought into butting contact with each of the rocker arm output portions 15,15. The combustion chamber 17 has a pent roof shape. As shown in FIG. 1(B), the cylinder head 14 has a surface 39 opposing the piston 25. The surface 39 is opened for providing the respective valve openings 3,4 and an opening 22 for inserting an ignition plug 21. The ignition plug 21 is inserted into the opening 22 and has its electrodes arranged at a central portion of the combustion chamber 17.

As shown in FIG. 1(A), when seen in the direction parallel to the cylinder center axis 7, each of the ports 1,2 projects from each of the valve openings 3,4 in a direction opposite to an inter-valve opening portion 18.

As shown in FIG. 5, when seen in the direction parallel to the crank shaft center axis 8, the cylinder 19 is inclined. The valve operating cam shaft 9, the tappets 10,10 and the push rods 11,11 are arranged on a lower one of right and left sides, namely left side of the cylinder block 12. The cam shaft 9 is disposed on a lower side, namely left side within the crank case 42*a*. The governor 32 is arranged on a higher side, namely right side of the crank case 42*a*. The crank case 42a has an upper portion provided with a fuel tank 29. The cylinder head 14 has an air cleaner 30 and an exhaust muffler (not shown) arranged at its upper portion.

In this engine, on the assumption that the side on which a cooling fan (not shown) is provided is the front and the side on which the valve operating cam shaft 9 exists is the left, the intake port 1 projects forwards and the exhaust port 2 projects rearwards. The rocker arm 40 for the intake valve 5 and that for the exhaust valve 6 are arranged on the front side and the rear side, respectively. Further, the rocker arm input portion 16 for the intake valve 5 and that for the exhaust valve 6 are arranged on the left side and the right side, respectively.

As shown in FIGS. 1(A) and 3(A), the cylinder block 19 and the cylinder head 14 are opened for providing an oil mist communication hole 35 communicating the crank case 42*a* with the rocker arm chamber 20*a*. The communication hole 35 is positioned on an inclined upward side near a hole 45*a* for inserting the intake valve axis 45 within the rocker arm chamber 20*a*. This arrangement intends to effectively pour on the valve operating mechanism, the oil mist introduced from the crank case 42*a* into the rocker arm chamber 20*a*.

Each of the rocker arms 40, as shown in FIG. 1(A) and FIGS. 4(A) to 4(C), comprises an elongated rocker arm boss 13*a*, a rocker arm input portion 16 projecting from a right end portion of the boss 13*a* and a rocker arm output portion 15 projecting from a left end portion of the boss 13*a* in a direction opposite to the rocker arm input portion 16. The rocker arm bosses 13*a*,13*a* are adapted to be supported by pivots 38,38 bridged between two pairs of right and left bearing boss portions 36,37 to be mentioned later.

As shown in FIG. 1(A) and FIGS. 3(A) to 3(C), the rocker arm chamber 20*a* includes a pair of right and left bearing boss portions 36,36 on its inclined upward side and a pair of right and left bearing boss portions 37,37 on its inclined downward side (two pairs of bearing boss portions 36,37 in total). The paired boss portions 36,37 are cast integrally with the cylinder head 14, respectively. Each of the rocker arm bosses 13*a* is arranged between each pair of the bearing boss portions 36 and 37 and supported by each of the pivots 38.

Each of the bearing boss portions 36 arranged on the inclined upward side has an upper face provided with a pair of ribs 41,41 projecting therefrom as shown in FIG. 1(A) as well as in FIGS. 3(A) and 3(B). There is formed between the paired ribs 41,41 an oil guide groove 41*a* having its inclined downward side tapered. On the other hand, each of the rocker arm bosses 13*a* has an inclined upward end portion provided with a horizontally U-shaped rib 43 projecting therefrom. Formed within each rib 43 is an oil introducing opening 43*a* opposing a lower end opening of each oil guide groove 41*a*. Further, each of the rocker arm bosses 13*a* has an inclined downward end portion provided with an oil lead-through opening 43*b* as shown in FIG. 4(C).

The above arrangement enables this lubricating device to be put into practice by a simple reconstruction at a low cost. Besides, the oil mist introduced into the rocker arm chamber 20*a* pours on the upper face of each bearing boss portion 36 positioned on the inclined upward side as well. Thus oil is collected by the oil guide grooves 41*a*,41*a* each having its inclined downward side tapered. The oil is introduced into the rocker arm bosses 13*a* through the oil introducing openings 43*a* opposing the oil guide grooves 41*a* to lubricate the rocker arm pivoted portions 13*a*. Therefore, even if the rocker arm bosses 13*a* are elongated, it is possible to maintain a high lubricating performance.

Each pivot 38 has an axial intermediate portion reduced in diameter as shown in FIG. 3(C) so as to form an oil reservoir 38*b* within each rocker arm boss 13*a*. This arrangement intends to store in each of the oil reservoirs 38*b* the oil introduced through each oil introducing opening 43*a* into each rocker arm boss 13*a* and lubricate an inner portion of each rocker arm pivoted portion 13 more reliably. Each oil lead-through opening 43*b* is provided on the inclined downward end portion of each rocker arm boss 13*a* because of an attempt to replace the oil within each oil reservoir 38*b* with new one as the time goes by. Each pivot 38 has an inclined upward end portion provided with a retaining ring 38*a*, which prevents each pivot 38 from falling down by its own weight.

The paired boss portions 36,36 provided on the inclined upward side are arranged close to right and left valve spring retaining seats 33,33 as shown in FIG. 3(B) and formed along the intake and exhaust valve axes 45,46 so as to shape a letter 'V'. Further, they are formed integrally with a bottom portion 48 while projecting therefrom, on the inclined upward side within the rocker arm chamber 20*a*. In this state, although the respective bearing boss portions 36,36 appear to interfere with the retaining seats 33 of the valve springs 31,31 in plan view, there is no likelihood that the respective bearing boss portions 36,36 interfere with the valve springs 31,31 since the respective valve axes 45,46 are also arranged to form a V-shape. As such, the paired bearing boss portions 36,36 are formed so as to shape a letter 'V' because of an intention to make the cylinder head 14 and the head cover 20 compact. Further, numerals 45*a*,46*b* in FIG. 3(B) indicate respective holes for inserting valve axis guides.

On the other hand, the respective bearing boss portions 37,37 provided on the inclined downward side are also formed integrally with right and left bottom portions 44,44 while projecting therefrom, on the inclined downward side within the rocker arm chamber 20*a*. This intends to curb a cost increase more than the case of providing the respective bearing boss portions separately therefrom. In addition, there is cast an inclined return groove 49 of lubricant between the right and left bottom portions 44,44 as shown in FIG. 3(A). This attempts to inhibit the lubricant from staying at the bottom portions 44,44 and return it into the crank case 42*a*.

The inclined return groove 49 has a lower end connected to a lower bottom portion 47 formed stepwise within the rocker arm chamber 20*a*. The bottom portion 47 is opened so as to provide holes 11*a*,11*a* for inserting the push rods 11,11. The respective insertion holes 11*a*,11*a* have inclined downward portions 11*b*,11*b* extending to an inclined downward peripheral edge of the bottom portion 47. Thus the lubricant dropped down on the bottom portions 44,44 on the inclined downward side returns from the return groove 49 to the crank chamber 42*a* via the inclined downward portions 11*b*,11*b* of the push rod insertion holes 11*a*,11*a*.

The first embodiment is applicable not only to an inclined engine but also to a horizontal engine having a horizontal cylinder. Further, the second embodiment is applicable not only to the inclined engine but also to a vertical engine having a vertical cylinder and the horizontal engine.

What is claimed is:

1. An overhead valve engine comprising an intake port (1) and an exhaust port (2), the intake port (1) and the exhaust port (2) projecting from the respective of an intake valve opening (3) and an exhaust valve opening (4) in mutually opposing directions, the intake valve (4) having an axis (45) inclined toward the projecting direction of the intake port (1), the exhaust valve (6) having an axis (46) inclined toward the projecting direction of the exhaust port (2), wherein when seen in a direction parallel to a cylinder center axis (7), on the assumption that a crank shaft center axis (8) is oriented in a front and rear direction and that a right and left direction is perpendicular to the crank shaft center axis (8), any one of a valve operating cam shaft (9), axes (45),(46) of the respective valves (5),(6) and the respective ports (1),(2) being oriented substantially in the front and rear direction, the cam shaft (9), tappets (10),(10) and push rods (11),(11) being arranged on either of right and left sides of a cylinder block (12), rocker arms (40),(40) being provided in a cylinder head (14), rocker arm pivoted portions (13),(13) being oriented substantially in the right and left direction and arranged side by side in the front and rear direction, each of rocker arm output portions (15),(15) projecting from one end portion of each of the rocker arm pivoted portions (13),(13) in a direction opposite to a space between the pivoted portions (13),(13), each of rocker arm input portions (16),(16) projecting from the other end of each of the pivoted portions (13),(13) toward the space between the pivoted portions (13),(13), the rocker arm input portions (16),(16) being arranged side by side in the right and left direction between the pivoted portions (13),(13).

2. An overhead valve engine as set forth in claim 1, wherein when seen in the direction parallel to the cylinder center axis (7), respective cams (9*a*), (9*a*) of the cam shaft (9) are arranged in the front and rear direction with a mid portion between the rocker arm pivoted portions (13),(13) interposed therebetween and the rocker arm input portions (16),(16) are disposed in the right and left direction with a center axis (9*b*) of the valve operating cam shaft (9) interposed therebetween.

3. An overhead valve engine as set forth in claim 1 or claim 2, wherein one combustion chamber (17) is provided with one intake valve (5) and one exhaust valve (6), respectively, and when seen in the direction parallel to the cylinder center axis (7), the valve axes (45),(46) of the respective valves (5),(6) are arranged at positions deviated toward the push rods (11),(11) with reference to the crank shaft center axis (8), the respective valve axes (45),(46) having ends brought into butting contact with the rocker arm output portions (15),(15).

4. An overhead valve engine as set forth in claim 1 or claim 2, wherein the combustion chamber (17) has a pent roof shape.

5. An overhead valve engine as set forth in claim 1 or claim 2, wherein when seen in the direction parallel to the cylinder center axis (7), each of the ports (1),(2) projects from each of the valve openings (3),(4) in a direction opposite to an inter-valve opening portion (18).

6. An overhead valve engine as set forth in claim 1 or claim 2, wherein when seen in the direction parallel to the crank shaft center axis (8), the cylinder (19) is inclined, and the valve operating cam shaft (9), the tappets (10),(10) and the push rods (11),(11) are arranged on a lower one of right and left sides of the cylinder block (12).

7. The overhead valve engine as set forth in claim 1 or 2 wherein an oil mist communication hole (35) communicates a crank case (42*a*) with a rocker arm chamber (20*a*), the oil mist introduced from the crank case (42*a*) into the rocker arm chamber (20*a*) being adapted to lubricate the rocker arm pivoted portions (13), (13), the rocker arm chamber (20*a*) including two pairs of bearing boss portions (36), (37) at the respective of its higher and lower portions, each of rocker arm bosses (13*a*) being arranged between each pair of the bearing boss portions (36), (37) and supported by a pivot (38), each of the bearing boss portions (35), (36) positioned at the higher portion having a face provided with a downwardly tapering oil guide groove (41*a*).

8. An overhead valve engine as set forth in claim 7, wherein each of the rocker arm bosses (13*a*),(13*a*) has an upper end portion provided with an oil introducing opening (43*a*) opposing a lower end opening of each of the oil guide grooves (41*a*).

9. An overhead valve engine as set forth in claim 7, wherein each of the pivots (38),(38) has an axial intermediate portion reduced in diameter to form an oil reservoir (38*b*) within each of the rocker arm bosses (13*a*),(13*a*).

* * * * *